US005470148A

United States Patent [19]

Gorr et al.

[11] Patent Number: 5,470,148

[45] Date of Patent: Nov. 28, 1995

[54] PORTABLE CEMENT-MIXING APPARATUS HAVING UPPER AND LOWER NOTCHED PLATES AFFIXED TO A SHAFT

[76] Inventors: Richard H. Gorr, 448 Baldwin Place Rd., Mahopac, N.Y. 10541; Gunther R. Siegel, Walsh Rd., Lagrangeville, N.Y. 12540

[21] Appl. No.: 170,011

[22] Filed: Dec. 20, 1993

[51] Int. Cl.[6] ..... B28C 5/08

[52] U.S. Cl. ..... 366/64; 366/343; 366/328.1; 416/231 A; 416/DIG. 3

[58] Field of Search ..... 366/64–66, 262–265, 366/270, 325, 328, 330, 342, 343, 605; 416/231 A, DIG. 3

[56] References Cited

U.S. PATENT DOCUMENTS

| | | | |
|---|---|---|---|
| 579,668 | 3/1897 | Wilson | 416/231 A |
| 667,389 | 2/1901 | Foote | 366/263 X |
| 1,072,219 | 9/1913 | Fay | 366/263 X |
| 3,147,958 | 9/1964 | Stiffler | 416/231 A |
| 3,166,303 | 1/1965 | Chapman | 366/64 X |
| 3,630,636 | 12/1971 | Hill | 416/231 A |
| 5,090,816 | 2/1992 | Socha | 416/231 A |

*Primary Examiner*—David A. Scherbel
*Assistant Examiner*—Charles Cooley
*Attorney, Agent, or Firm*—Michael J. DeSha

[57] ABSTRACT

The apparatus for mixing cement includes a shaft connected to an engine for rotating the shaft. The shaft has mounted thereon a plurality of paddles for providing a pushing force and arranged so as to channel the flow of cement mix about the shaft to allow complete and efficient mixing. In one embodiment the paddles are arranged with faces parallel to the axis of the shaft and apertures are cutout for controlling the flow. In another embodiment, the paddles are notched plates that are bent to provide pushing surfaces and formed so as to channel the flow about the shaft.

1 Claim, 3 Drawing Sheets

PORTABLE CEMENT-MIXING APPARATUS HAVING UPPER AND LOWER NOTCHED PLATES AFFIXED TO A SHAFT

FIELD OF THE INVENTION

The invention relates to apparatus for mixing cement and more particularly to a portable mixing apparatus suitable for mixing batches of cement.

BACKGROUND OF THE INVENTION

As is well known, there are many applications for cement and concrete in most areas of construction. Since cement sets very quickly once water is added, batches typically must be mixed on site. For very small amounts, there is no problem in using manual labor with trowel or shovel for the mixing and for relatively large amounts one can more economically purchase truckloads of mixture which are delivered to the site in cement trucks. However, for the amounts between these extremes, mixing cement is not an easy task since motorized devices for mixing the cement are not conveniently available.

It is known, for example, to provide a rotatable electric-motor-driven container having an opening which is positionable at an angle at which the container may be filled with cement mix and water and which may after mixing then be tilted for pouring into forms or for emptying the contents into other containers for carrying to the desired location at the site. Such devices typically can be rented at local tool rental outlets, but they must either be towed or disassembled before transporting and will conveniently fit only in a truck or van. These containers are awkward to use because of the height of the opening where the cement mix is put in. A typical total mixing time for 240 pounds of cement in these devices is about 15 minutes and the cleanup of these machines is both time-consuming and messy.

There are mixing devices available from the Exaco company which are represented as being useful for mixing cement. When a device such as the Exaco Mixer Model 140 is actually used for mixing a thick mixture such as e.g. ready mix concrete, there is essentially no control of the unit's entry points into the mix and the cement is thrown outward away from the paddles so that there is no cement near the center. The resulting composition of the cement mix has been found to be poor. The blades of the mixer simply slice through the mixture without blending it.

Other mixing devices are available from Jiffler. These devices are represented as being desirable for mixing of materials such as paints because no air is introduced into the mix. It is known that for the best quality cement, there must be air incorporated into the mix. Consequently this device has not been found suitable for the mixing of cement.

SUMMARY OF THE INVENTION

It is therefore an object of the invention to provide a novel apparatus for mixing cement.

It is a further object to provide a motorized device which is portable and which may be used on site for rapidly mixing relatively large amounts of cement in an efficient manner to provide a quality cement mixture.

These and other objects are achieved by apparatus for mixing cement comprising an engine, a shaft having two ends, the engine being connected to the shaft at one end thereof for rotation of the shaft, a plurality of paddles arranged about the shaft near the other end of the shaft, said paddles extending outwardly from the shaft and being shaped so as to include a portion for providing a pushing force about the shaft as the shaft rotates, and said paddles also being further shaped such as to form apertures for channeling flow around the shaft.

DESCRIPTION OF THE PREFERRED EMBODIMENT

Figure 1:
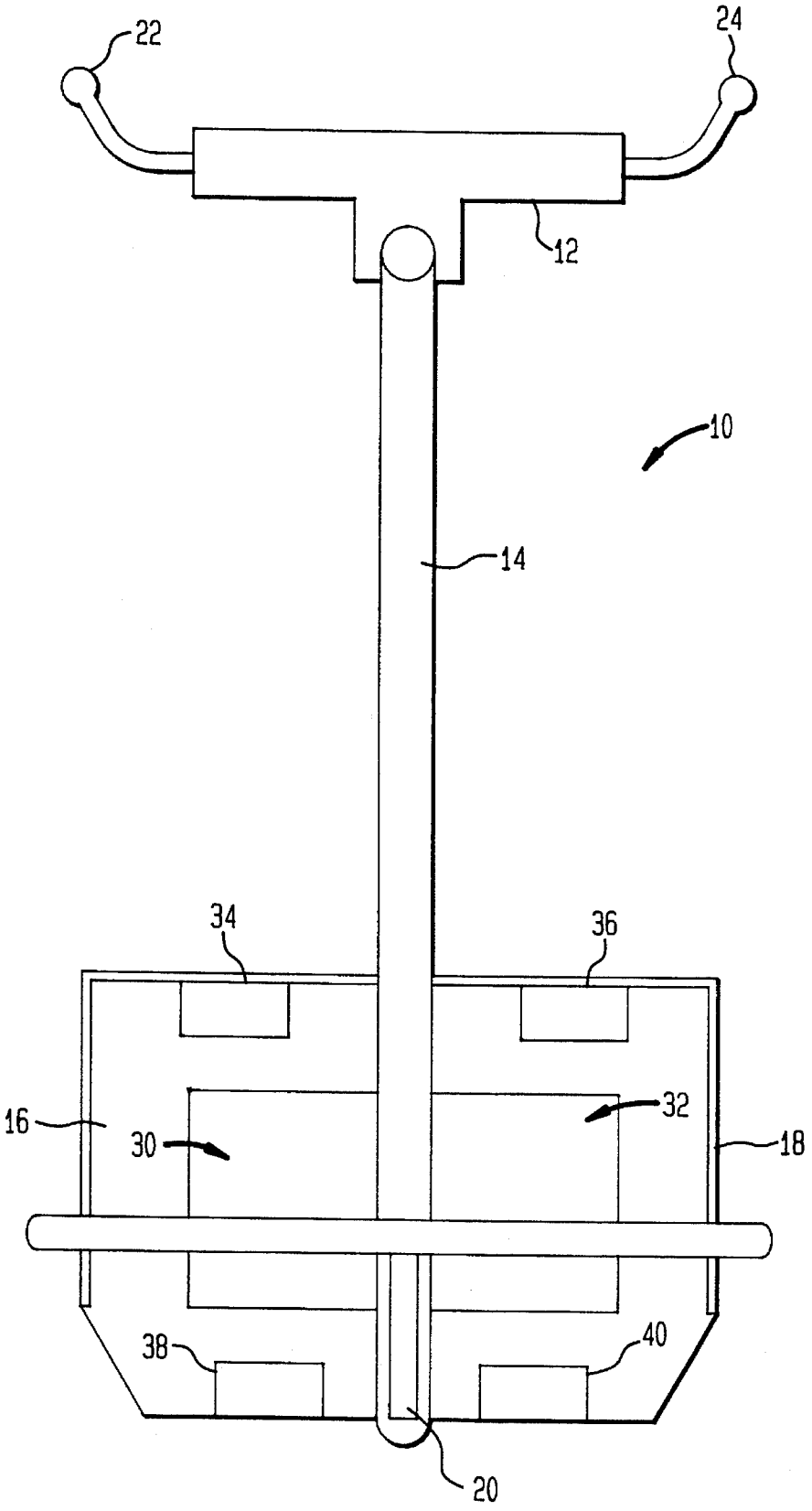
FIG. 1. is a side view of an embodiment of a cement mixing apparatus in accordance with the invention.

In FIG. 1, there is shown in a schematic side view generally at 10 a first embodiment of a mixing device in accordance with the invention. The device 10 includes an engine 12 with its drive shaft connected to shaft 14. The shaft 14 has a plurality of paddles as seen at 16, 18, and 20 affixed at its lower end.

In a preferred embodiment, the engine may be a 2-horsepower gasoline engine such as the 2HP Model 8900 available from Macro Tool & Mach. Company. It will be understood however that an electric motor may be used in place of the gasoline engine if desired. Handles 22 and 24 are mounted on each side of the engine for holding the device for operation.

For best results in either case, the motor should be a variable speed motor in order to allow entry of the paddles into a mix at low speed while enabling the rotation to increase to a speed of about 200 rpm for efficient mixing to occur.

Figure 2:
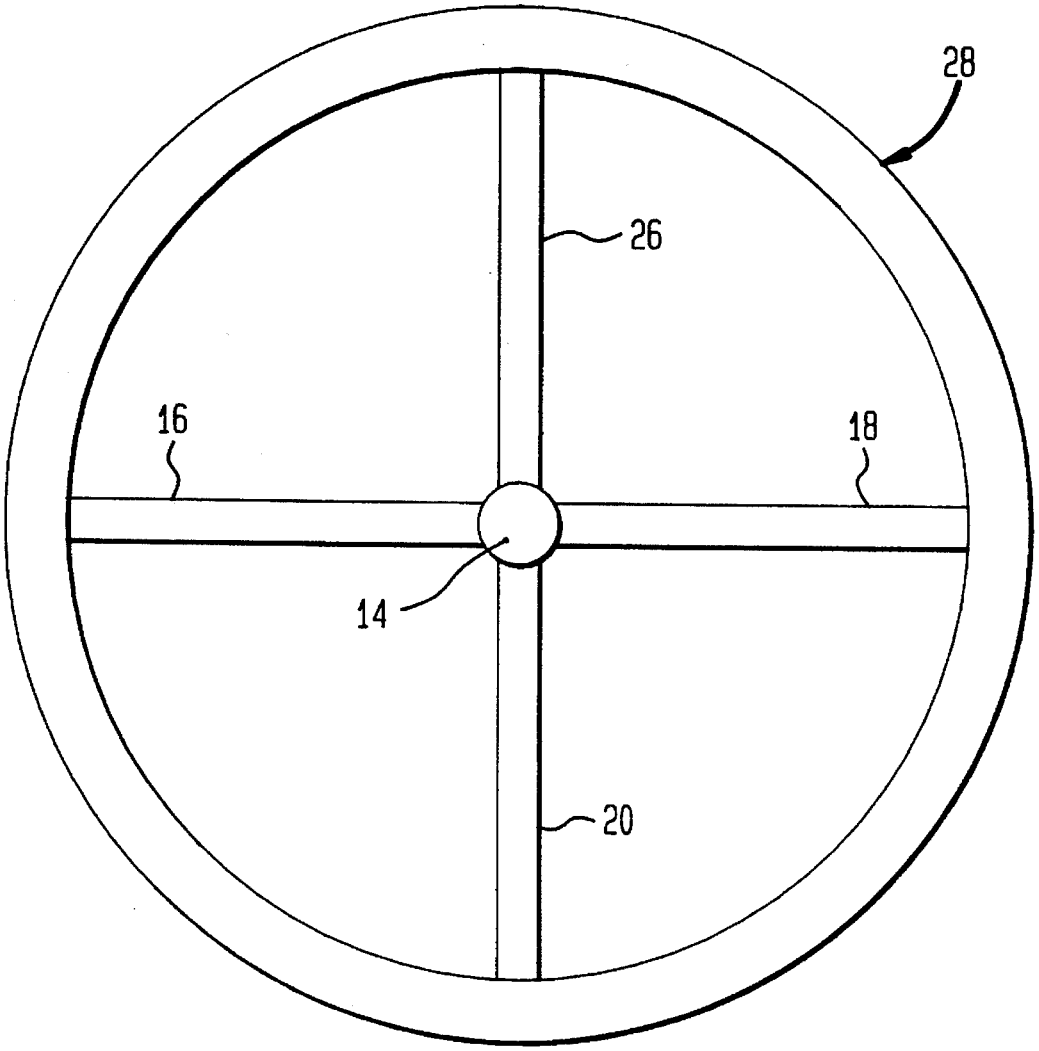
FIG. 2 is a top view of the paddles of FIG. 1.

Shaft 14, preferably of ⅝-inch stock, may be attached to the output drive shaft of the engine by means of welding or a sleeve using bolts or the like connectors (not shown) as is well known in the art. As seen also in FIG. 2 which is a top view of the paddles of FIG. 1 there are suitably four paddles, one paddle 26 not being seen in FIG. 1. The outside edge of the paddles are suitably attached to a stabilizing ring 28 for holding them rigidly in place. In order to properly mix the cement mixture, it has been found to be important that the paddles provide both a pushing component of force on the mixture and determined apertures or channels to channel the mixture into appropriate flow patterns for efficient mixing and incorporation of air. In the illustrated embodiment of FIGS. 1 and 2, pushing forces are provided during rotation by making the faces of the paddles substantially parallel to the axis of the shaft and the flow channels are provided by cutouts or apertures 30 and 32 in paddles 16 and 18 as shown. Paddles 20 and 26 are preferably about one half the height of the other paddles and have respective cutout portions corresponding to the lower half of paddles 16 and 18. It will be appreciated that other optional flow windows such as those shown at 34, 36, 38, and 40 may be used for fine-tuning the flow patterns. The bottom of the paddles should be able to sweep along the bottom of the container in which the mix is held: therefore, for best results, the stabilizing ring must be above the bottom portion of the paddles.

Figure 4:
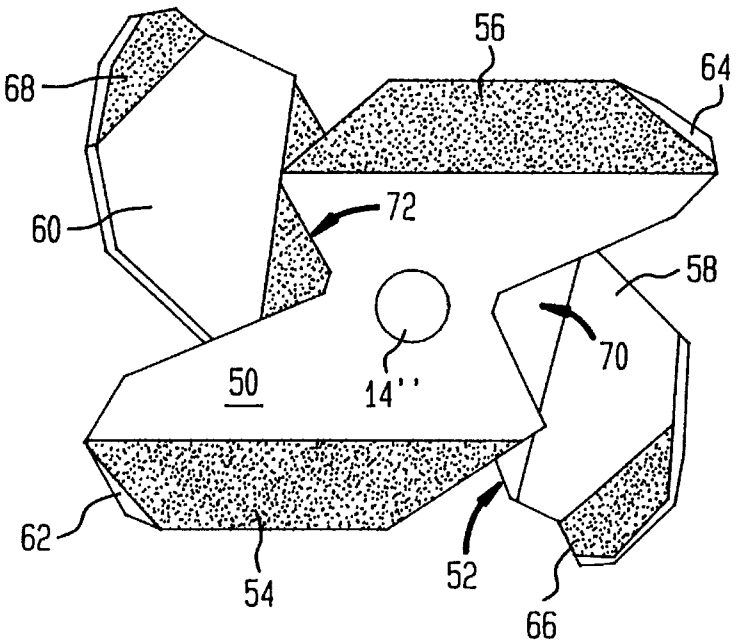
FIG. 4 is a top view of the paddles of the embodiment of FIG. 3.
Figure 3:
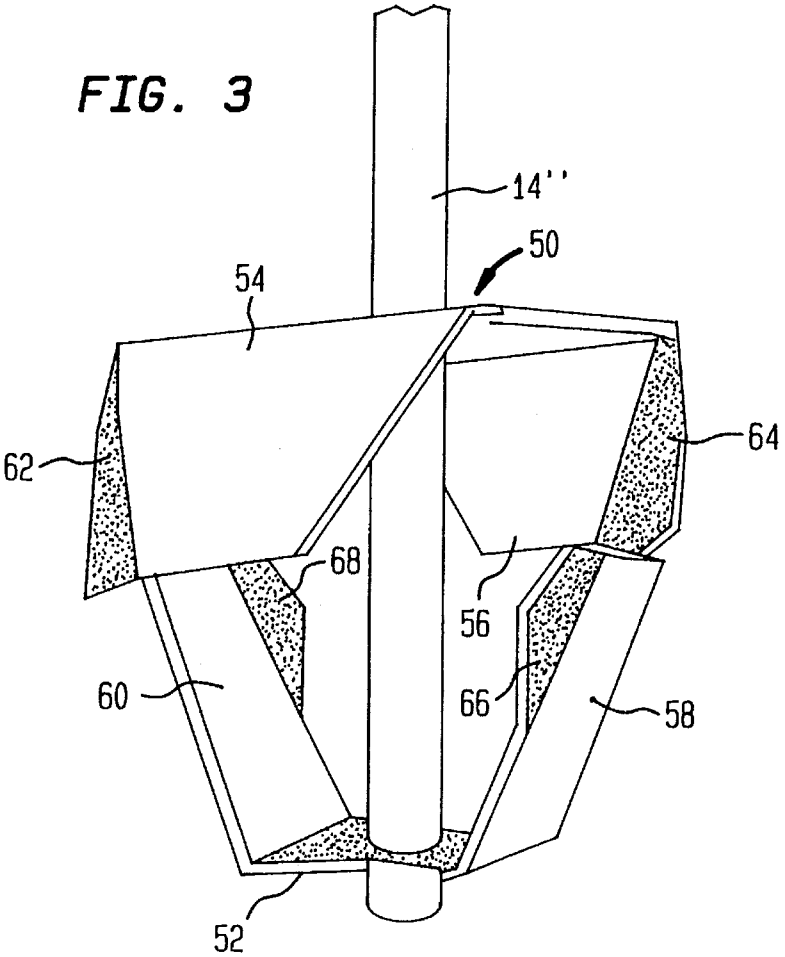
FIG. 3 is a side view of another embodiment of a shaft and paddles for a mixing device in accordance with the invention.

FIG. 3 is a side view and FIG. 4 is a top view of another embodiment of mixing paddles for use in accordance with the invention. Shaft 14" may be connected to an engine (not shown) as described in connection with FIG. 1. As illustrated in FIGS. 3 and 4, there are attached to the shaft 14" by conventional means, such as welding for example, paddles comprising two bent metal plates 50 and 52 which are configured so as to provide the pushing forces and the channels for flow of the mixture. The plates 50 and 52 are bent respectively downward and upward at bend lines so as to form respectively opposed vanes or wings 54, 56, 58, and 60. As seen in FIG. 3 and 4, each of the plates 50 and 52 have two ends which are disposed at a radial distance from the shaft which is substantially greater than a radial distance of the bend lines from the shaft. These wings or vanes are again preferably bent at the trailing edge sections 62, 64, 66, and 68 to provide respective areas for applying force (pushing) against the mixture as the shaft 14" is rotating. It will be appreciated that the location of the opposed wings or vanes form an open volume therebetween which will cause the mixture to flow appropriately. As best seen in the top view of FIG. 4, the plates 50 and 52 are shaped such that the flat portions appear notched as illustrated at 70 and 72. It will be understood that the lower plate has similar notches (hidden by the upper plate 50). For ease in entering a mixture there may be included on the leading edges of the notches on the lower plate a sharpened portion or an extension including an inclined plane (not shown) forming a blade with a sharp edge to allow the flat portion of the plate to initially slice through the mixture as the device is moved into position for mixing. It has been found that this configuration results in extremely efficient mixing and provides excellent quality mix.

It will be understood that in the case of either embodiment, the length of the shaft may be varied as desired in order to accommodate the various situations that occur on site. The shaft length may be for example 13-inches for use of the device with mix in a wheelbarrow. The shaft is conveniently 25-inches for use with a mortar box and may be up to 36-inches if desired for mixing of cement in sono tubes within the conventional forms of the various known types.

For operation, a cement mix such as Ready-Mix is poured into a conventional container such as a wheelbarrow or a mortar box and the required water is added. The paddles of the mixer in either embodiment are caused to rotate at low speed and are slowly pushed into the mix using the rotating action to allow the paddles to dig into the mix. The speed of the shaft is gradually increased to approximately 200 rpm and the unit is swept along the bottom and sides to incorporate dry mixture and to cause the mixing of the wetted mix.

One using the mixer in accordance with the invention is able to readily accomplish the mixing of 240-lbs of ready mix cement at one time in, for example, a common wheelbarrow instead of a special container. The device in accordance with the invention requires only one entry into the mixture, easily penetrates to the bottom, and slides easily across the bottom. Typically the cement is completely mixed in about three minutes.

What is claimed is:

1. Apparatus for mixing cement comprising an engine, a shaft having two ends, the engine being connected to the shaft at one end thereof for rotation of the shaft, a plurality of paddles arranged about the shaft near the other end of the shaft, said paddles extending outwardly from the shaft and comprising two notched plates affixed to the shaft, each of said notched plates having two ends one of said plates being an upper plate on said shaft and having vanes at each end of the plate bent toward the other lower plate at a bend line, the other lower plate having vanes at each end of the plate bent toward the upper plate at a bend line, each said vane having a trailing edge section bent with respect to each said vane for providing a pushing force and said vanes being arranged such that the ends of said vanes are disposed at a radial distance from the shaft which is substantially greater than a radial distance of the bend lines from the shaft thereby forming between the vanes and the shaft a substantially open volume to enable passage of coarse material and to channel flow around the shaft.

* * * * *